US005320493A

United States Patent [19]

Shih et al.

[11] Patent Number: 5,320,493

[45] Date of Patent: Jun. 14, 1994

[54] ULTRA-THIN LOW NOISE AXIAL FLOW FAN FOR OFFICE AUTOMATION MACHINES

[75] Inventors: Ming-Chuang Shih; Huan-Jan Chien, both of Hsinchu, Taiwan

[73] Assignee: Industrial Technology Research Institute, Hsinchu, Taiwan

[21] Appl. No.: 991,355

[22] Filed: Dec. 16, 1992

[51] Int. Cl.[5] ..... F04D 29/38

[52] U.S. Cl. ..... 416/223 R; 416/238

[58] Field of Search ..... 416/169 A, 189, DIG. 2, 416/223 R, 238

[56] References Cited

U.S. PATENT DOCUMENTS

| | | | |
|---|---|---|---|
| 3,367,423 | 2/1968 | Van Ranst | 416/238 |
| 4,548,548 | 10/1985 | Gray, III | 416/189 R |
| 4,569,631 | 2/1986 | Gray, III | 416/169 A |
| 4,569,632 | 2/1986 | Gray, III | 416/189 R |
| 4,971,520 | 11/1990 | Van Houten | 416/189 |

FOREIGN PATENT DOCUMENTS

| | | | |
|---|---|---|---|
| 0294688 | 12/1988 | European Pat. Off. | 416/238 |

*Primary Examiner*—Edward K. Look
*Assistant Examiner*—Mark Sgantzos
*Attorney, Agent, or Firm*—W. Wayne Lianh

[57] ABSTRACT

An ultra-thin low noise axial flow fan is provided for office automation machine. The center line along the blade from its root portion to its tip portion is circular arc form and it is perpendicular to the central hub. The leading edge skew angle at the tip portion of the blade is 47 degrees. The blade angle of each blade ranges from 57 to 63 degrees, which is first directly proportional to the radius of the blade and then inversely proportional to the radius of the blade from the root portion to the tip portion of the blade. The pitch-chord ratio of each blade is inversely proportional to the radius of the blade from the root port to the tip portion of the blade. The blade of the fan thereby generates high air flow and high pressure, and has advantages of low noise and ultra-thin outer casing.

6 Claims, 7 Drawing Sheets

ULTRA-THIN LOW NOISE AXIAL FLOW FAN FOR OFFICE AUTOMATION MACHINES

BACKGROUND OF THE INVENTION

The present invention relates to an axial flow fan, and more particularly to an axial flow fan with improved blades having advantages of ultra-thin dimension, low noise level high air flow, and high fan pressure, which is especially suitable for use in office automation Machines.

In a conventional axial flow fan, it is generally, composed of a driving motor, a cylindrical central section, a plurality of blades, and an outer casing for casing the fan. Each of the blades extends radially outward from the cylindrical hub section of the fan. A motor shaft the driving motor is attached to the hub section at a central aperture of the hub and thus the hub section may be rotated by the driving motor via the motor shaft. In such an arrangement, the hub section together with the blades may rotate about an axis of the outer casing in order to force air flow from inlet area to outlet area of the fan. The motor rotates the blades of the fan via the motor shaft so as to make the blades generate lift force which is in a form fan pressure and air flow.

It is known that the attack angle, camber angle, blade angle, pitch-chord ratio, and the shape of the blades are possible factors of affecting the lift force of the blades described above. In addition, the outer shape dimension of the blades also effects the features of the axial fan In the prior art, the above mentioned problems caused by the improper design relating to the lift force of the blades are as follows:

1. Improper Attack Angle

The different designs of the blade shape may result in different effective ranges of the attack angle and different lift factor of the blade. If the attack angle exceeds a proper value, it is highly possible to result in stall and greater noise. On the contrary, if the attack angle is improperly designed less than a proper value, it will be affect the lift force of the blade and correspondingly result in lower performance efficiency.

2. Improper Camber Angle

In theory, the larger the camber angle, the greater the lift force under a condition of constant attack angle. However, in practice, the attack angle will be correspondingly decreased in accordance with the increase of the camber angle. Consequently, the attack angle and the camber angle must be balanced to a proper value therebetween to get a best lift factor.

3. Improper Blade Angle

Under a condition of constant rotation speed, the blade angle exceeds or less than a proper value may result in the loss of the lift force.

4. Improper Chord-pitch Ratio Distribution

The improper design of the pitch-chord ratio may result in loss of the lift force of the fan. In practice, the chord-pitch ratio is less than 1 in order to be more convenient to be manufactured. It is found that the improper chord-pitch ratio distribution may result in fluid interference to the air flow. In addition, improper chord-pitch ratio also causes lower performance efficiency of the fan and make it difficult to minimized the outer casing of the fan.

Various prior U.S. patents had been developed in this field. For example, U.S. Pat. Nos. 4,971,520 and No. 4,569,631 disclosed an axial fan. However, the prior art patent can not effectively overcome the problems described above, especially the difficulty of minimizing the thickness of the outer casing.

SUMMARY OF THE INVENTION

Consequently, the primary object of the present invention is to provide an ultra-thin low noise axial flow fan, which is especially suitable for use in office automation machines. The axial flow fan of the present invention may meet the requirements of the attack angle, the camber angle, the blade angle, pitch-chord-ratio, and blade shape of the fan, so that the axial fan has features of super-thin dimension and noise reduction.

Typically, the fan widely used in office automation machines requires low noise, large air flow, and small dimension. The present invention is therefore especially designed to have an improved blade structure to meet the requirements of the office automation machine. The present invention is different from the conventional axial flow fan both in effects and structure. In effects, the present invention has lower noise level, small dimension, larger air flow. Hence, the fan of the present invention may widely be used in various application fields, especially in office automation machines, such as computers, power supplies, and so on.

To achieve tile objects of the present invention above, the axial velocity distribution of the preferred embodiment of the present invention is not a uniform gradient distribution. That is, the axial velocity of the tip portion of the blade is higher, while the root portion of the blades is lower. As a result, in a given width surface on the blade, the outer surface area is larger than the inner surface area, which will make the fan generate larger air flow. Besides, the pressure distribution of the fan of the present invention is also designed to a form of nonuniform gradient distribution as that of the axial velocity distribution, which make the fan generate larger pressure.

Because the axial velocity distribution and the pressure distribution of the fan of the present invention are not uniform, and the blade angle of each blade is first directly proportional to the radius of the blade and then inversely proportional to the radius of the blade, it is possible to delay the generating position of separating air flow of the fan, and therefore lower the lift loss of the fan. In addition, the noise level of the fan may be reduced efficiently.

Furthermore, the pitch-chord ratio of the present invention is inversely proportional to the radius of the blade. It is possible to minimize the dimension of the outer casing of the fan.

The other objects and features of the invention will become more apparent from the following description taken in connection with the accompanying drawings,

DETAILED DESCRIPTION OF THE INVENTION

Figure 1:
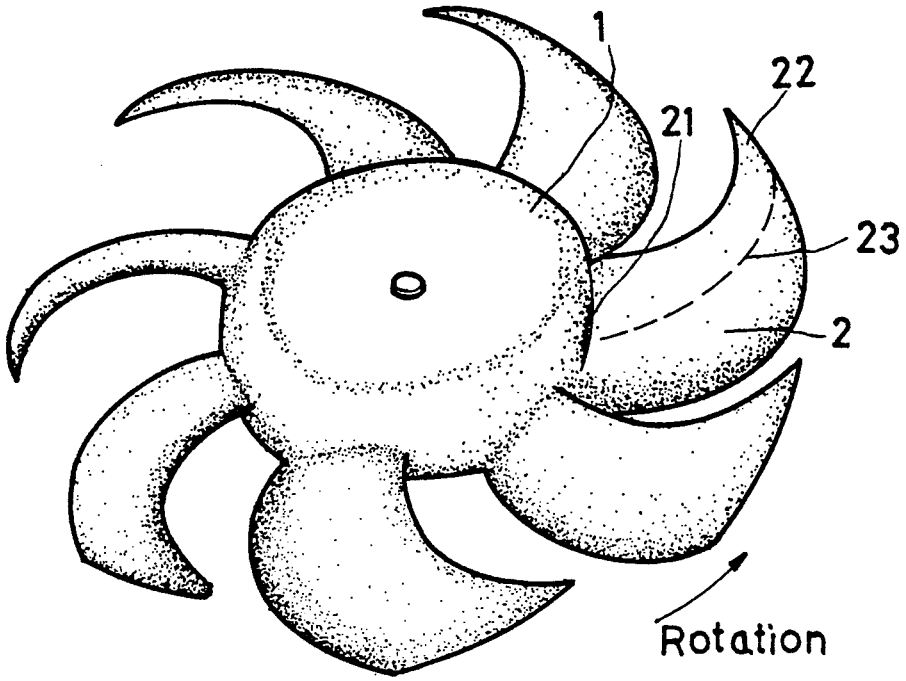
FIG. 1 shows a perspective view of the fan in accordance with the present invention.
Figure 2:
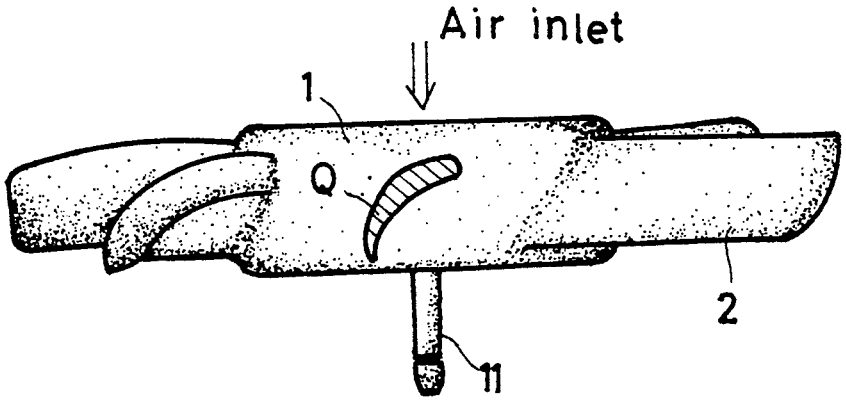
FIG. 2 is a partial sectional view of the fan shown in FIG. 1
Figure 3:
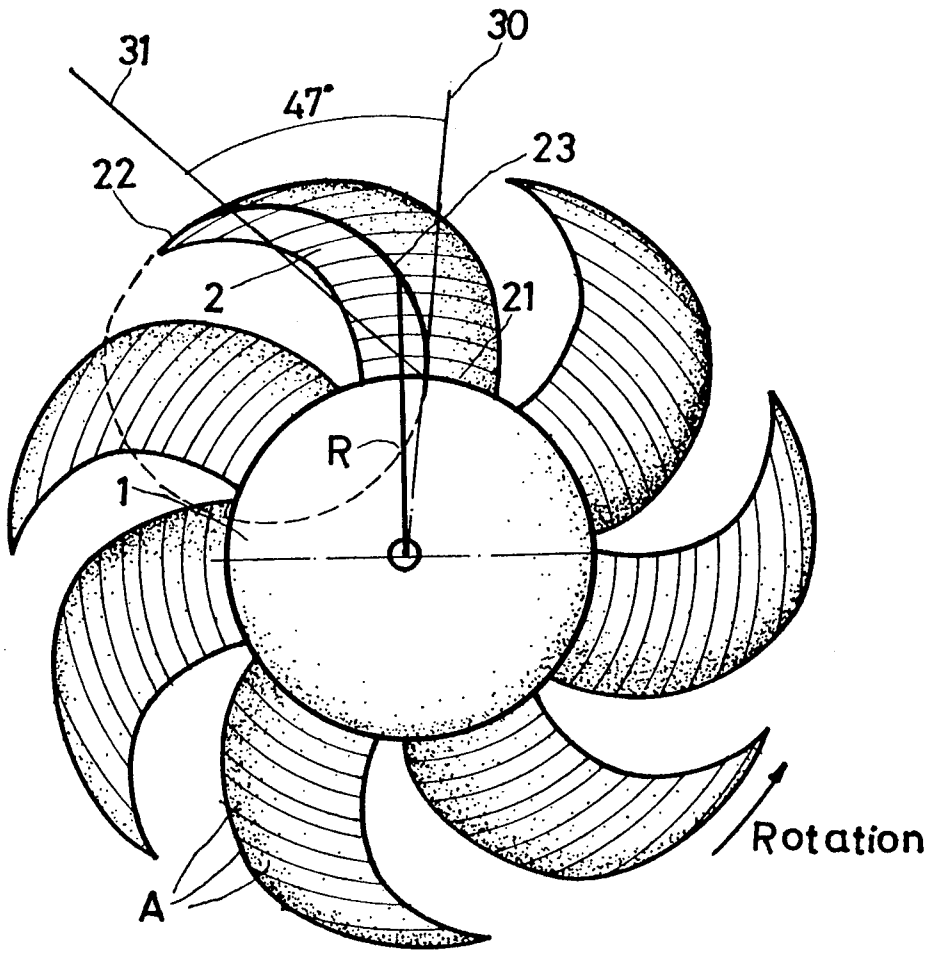
FIG. 3 is a front plan view of the fan shown in FIG. 1.

Referring now to FIG. 1 with reference to FIG. 2 and FIG. 3, it is shown a perspective view of the fan in accordance with the present invention, The fan has a central hub section 1 and the hub is rigidly attached with a shaft. 11. A driving motor (not shown) may rotate the fan about an axis of an outer casing (not shown) to force air via the shaft 11. The fan includes a plurality of blades formed thereon for drawing air from an inlet area and axially force the air towards an outlet area of the outer casing, Each blade is back skewed and extends from its root portion 21 radially outward from the hub 4 to its tip portion 22.

Figure 5:
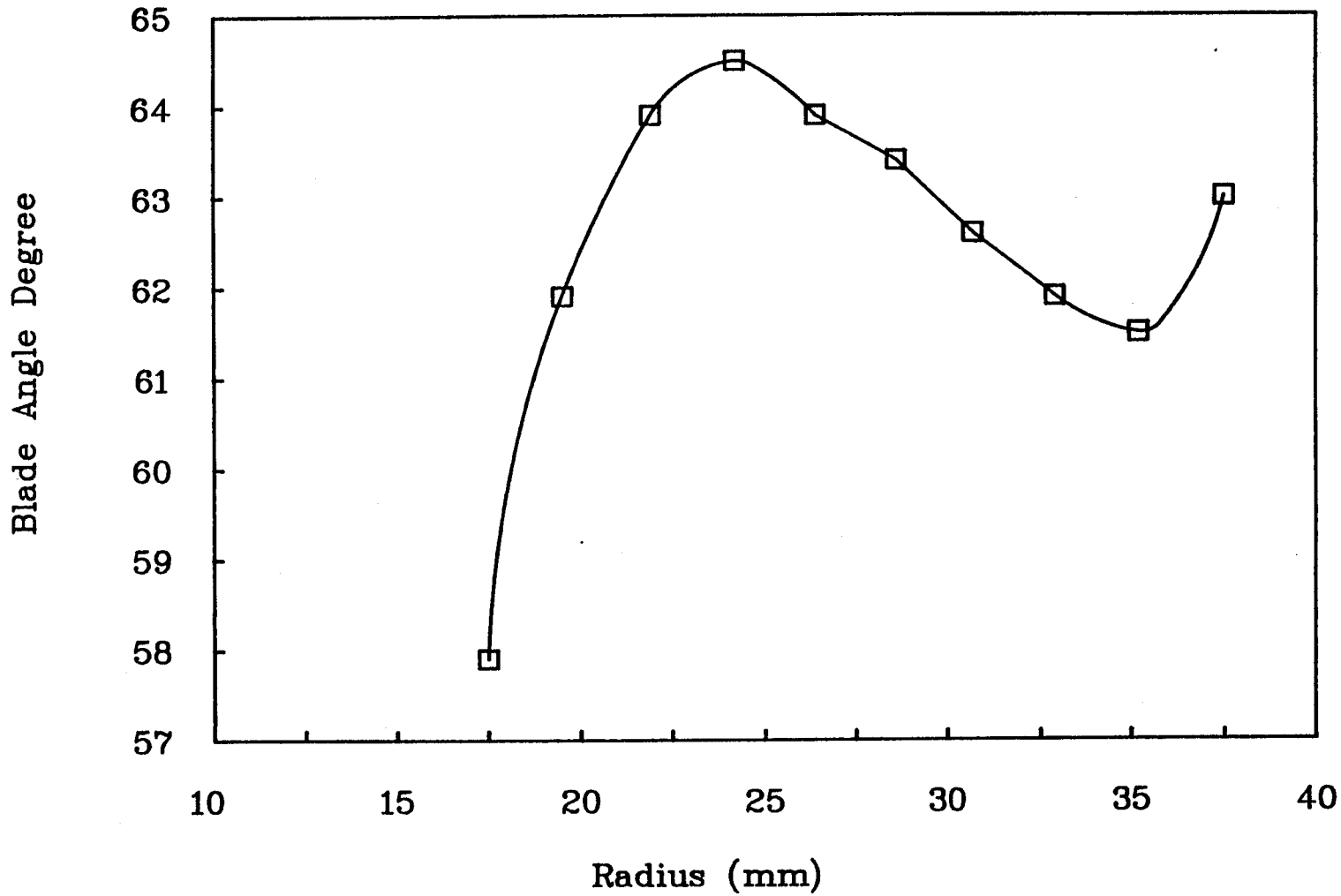
FIG. 5 is a graph depicting the blade angle versus radius of the blade of the present invention.
Figure 7:
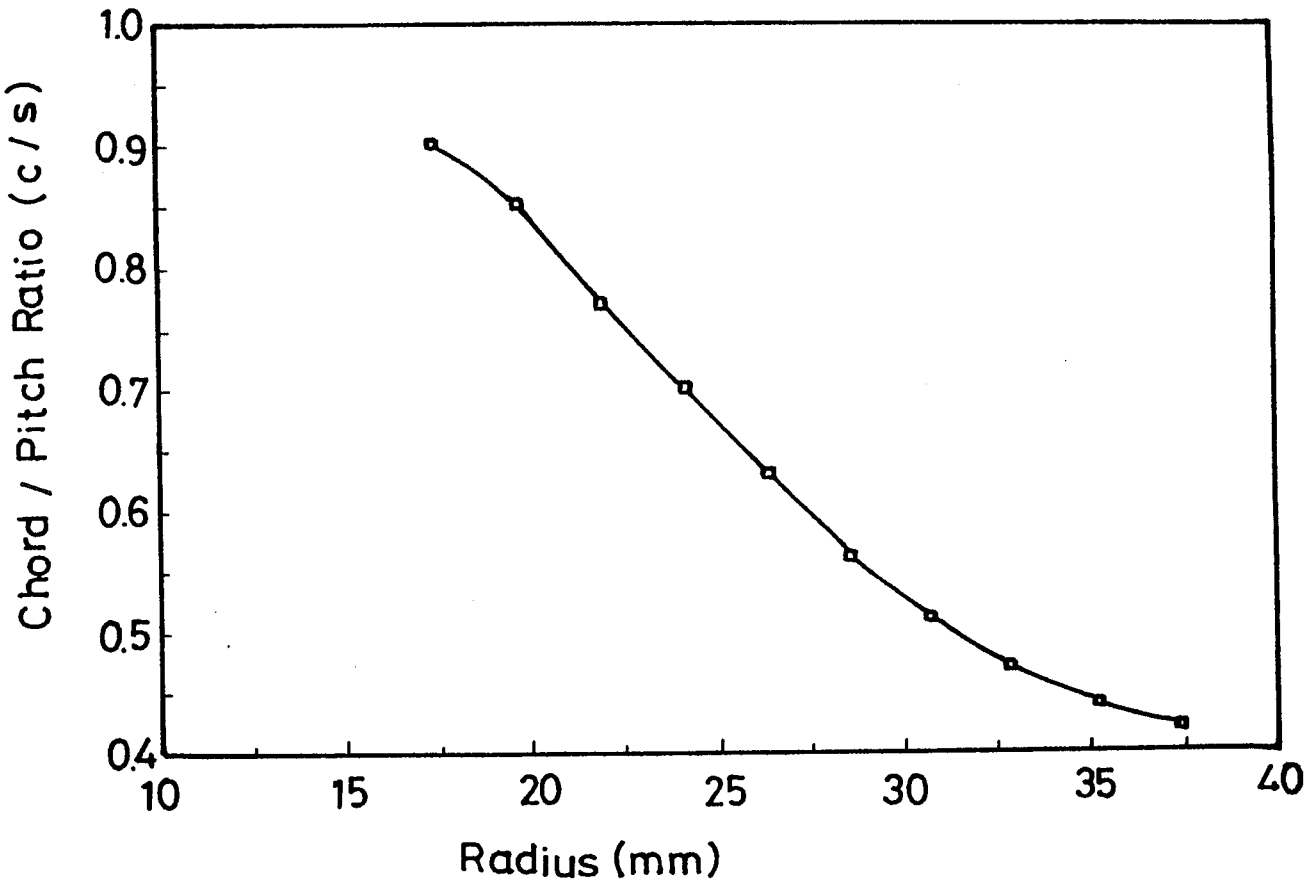
FIG. 7 is a graph depicting the chord/pitch ratio (c/s) versus radius of the blade of the present invention.
Figure 8:
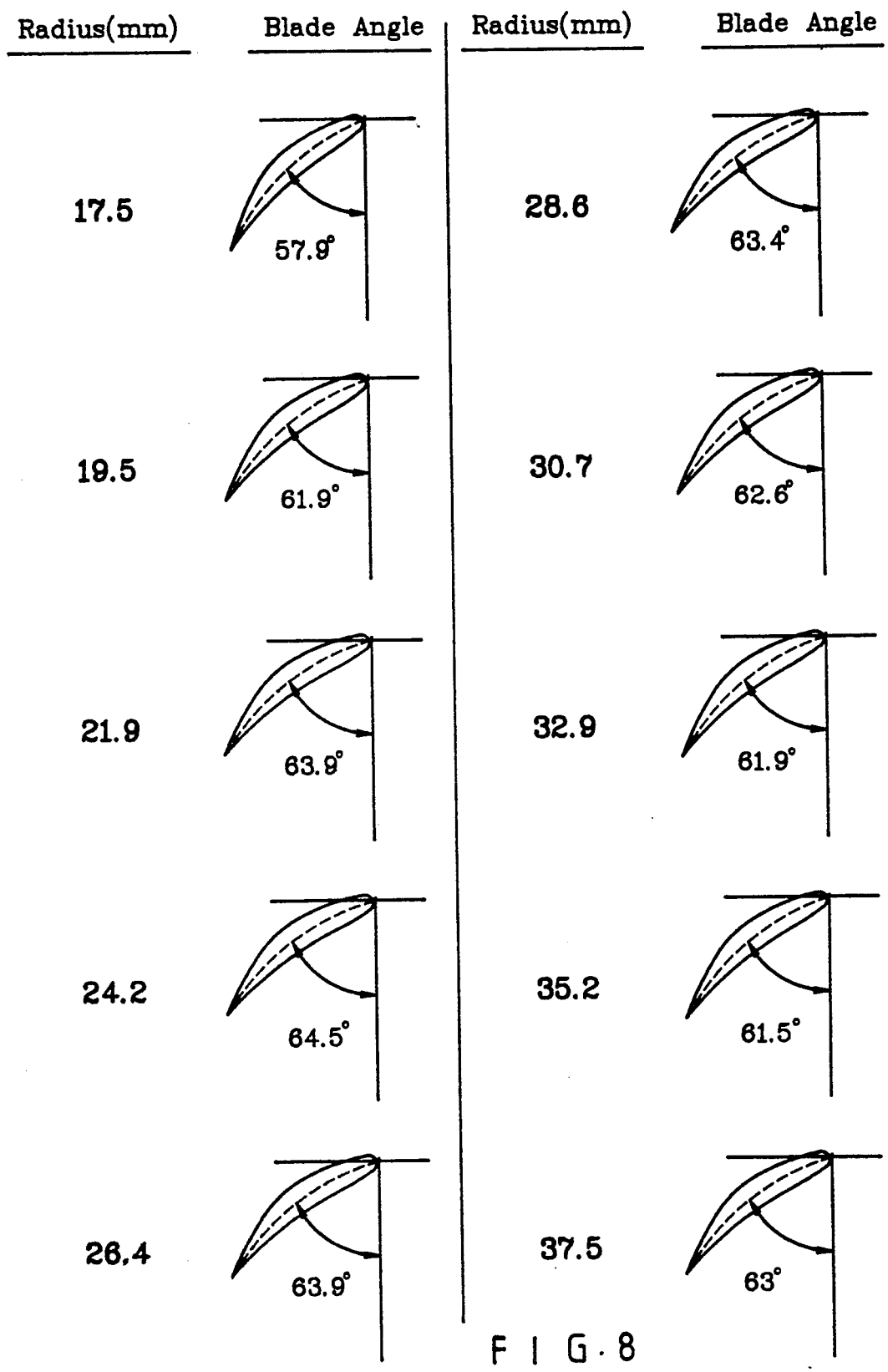
FIG. 8 is a plurality of cross sectional views of the fan blade of the present invention corresponding to the ten equal width sections as shown in FIG. 3.

Referring to FIG. 3, which shows a plan view of the of the present invention. The center line 23 along each blade from its root portion 21 to its tip portion 22 is a form of circular arc and the root portion of the blade is perpendicular to the outside flange of the hub section 1. The blade radius R is the radial distance from the center of the hub 1 to any point along the center line 23. The blade angle Q is the angle at any particular point of the blade from the vertical as shown in FIG. 2. The definition of blade is similar to that given in U.S. Pat. No. 4,569,632. The center line being defined as an arc connecting all the middle points between corresponding end points at the two sides of the blades as substantially shown in FIG. 3. As shown in FIG. 3, the shape of the blade is constructed in such a manner such that the center line along each blade from the root portion to the tip portion of the blade has the shape of a circular arc, which is perpendicular to a circle defining the hub section at the root portion of the blade. Also as shown in FIG. 3, the skew angle is measured as the angle between a first line 30, which is tangential to the center line at the root portion thereof, and a second line 31, which is drawn connecting the root portion and the tip portion of the center line. With reference to FIG. 5, it is noted that the blade angle of each blade 2 is first directly proportional to the radius of the blade, and then inversely proportional to the radius of the blade. With reference to FIG. 7, the pitch-chord ratio of the blade is inversely proportional to the radius of the blade. In such an arrangement, the fan of the present invention has characteristics of high air flow, high pressure, low noise, and an outer casing with ultra-thin dimension.

To further promote the features of the present invention, the axial velocity distribution of the fan at position of inlet area of the fan is not a uniform gradient distribution. That is, the axial velocity of the tip portion 22 of each blade is higher than that of the root portion 21 thereof. As a result, because the outer surface area is larger than the inner surface area of the given width surface on the blade, the fan may generate larger air flow. In accordance with the present invention, the pressure distribution of the fan is also designed to a form of nonuniform gradient distribution as that of the axial velocity distribution flow discussed above so as to increase the pressure of the fan.

It is noted from the above description, the axial velocity distribution and the pressure distribution of the fan of the present invention is not uniform, and the blade angle of each blade is first directly proportional to the radius of the blade and then inversely proportional to the radius of the blade. As a result, the generation position of separating air flow of the fan will be delayed, and therefore decrease the lift loss of the fan. In addition, the noise level of the fan may be reduced efficiently. It is to be understood that the novel structure of the present invention may obviously improve the problems of the prior art caused by the improper blade angle described above. Furthermore, because the pitch-chord ratio of the present invention is inversely proportional to the radius of the blade, the dimension of the outer casing of the present invention may be smaller than that of the conventional axial fan.

Based on the above considerations and theory with practical experiences, the novel blade of the present invention is designed and constructed. The related data of the preferred embodiment of the present invention are listed in Table 1 below (camber angle is defined below with reference to FIG. 4:

TABLE 1

| | | | | | | | | | | |
|---|---|---|---|---|---|---|---|---|---|---|
| Radius (mm) | 17.5 | 19.5 | 21.9 | 24.2 | 26.4 | 28.6 | 30.7 | 32.9 | 35.2 | 37.5 |
| Camber Angle | 40.39 | 41.49 | 42.09 | 42.49 | 43.34 | 41.7 | 40.33 | 39.35 | 37.37 | 35.95 |
| Blade Angle | 57.9 | 61.9 | 63.9 | 64.5 | 63.9 | 63.4 | 62.6 | 61.9 | 61.5 | 63 |

In the preferred embodiment of the present invention, the fan consists of 7 blades to form a complete fan structure. After the measurements above, it is found that the pressure, air flow, and noise level of the present invention are obviously superior to that of the conventional axial fan.

In the preferred embodiment of the present invention, it is noted that the fan is preferably composed of 7 blades, which may obtain a better gradient distribution of the air flow. Further, from the measured data in Table 1 above, it is noted that the blade angle degree ranges from 57–63 degrees. For viewing and analyzing the cross-sectional structure of the blade, the blade is cut into 10 equal-width segments from the root portion to the tip portion of the blade as shown in FIG. 3. Corresponding to the various radius of the blade from its root portion to its tip portion as listed in Table 1, the corresponding blade angles are 57.9, 61.9, 63.9, 64.5, 63.9, 63.4, 62.6, 61.9, 61.5 and 63 degrees respectively. The relationship between the radius and the blade angle is depicted in FIG. 5.

Figure 4:
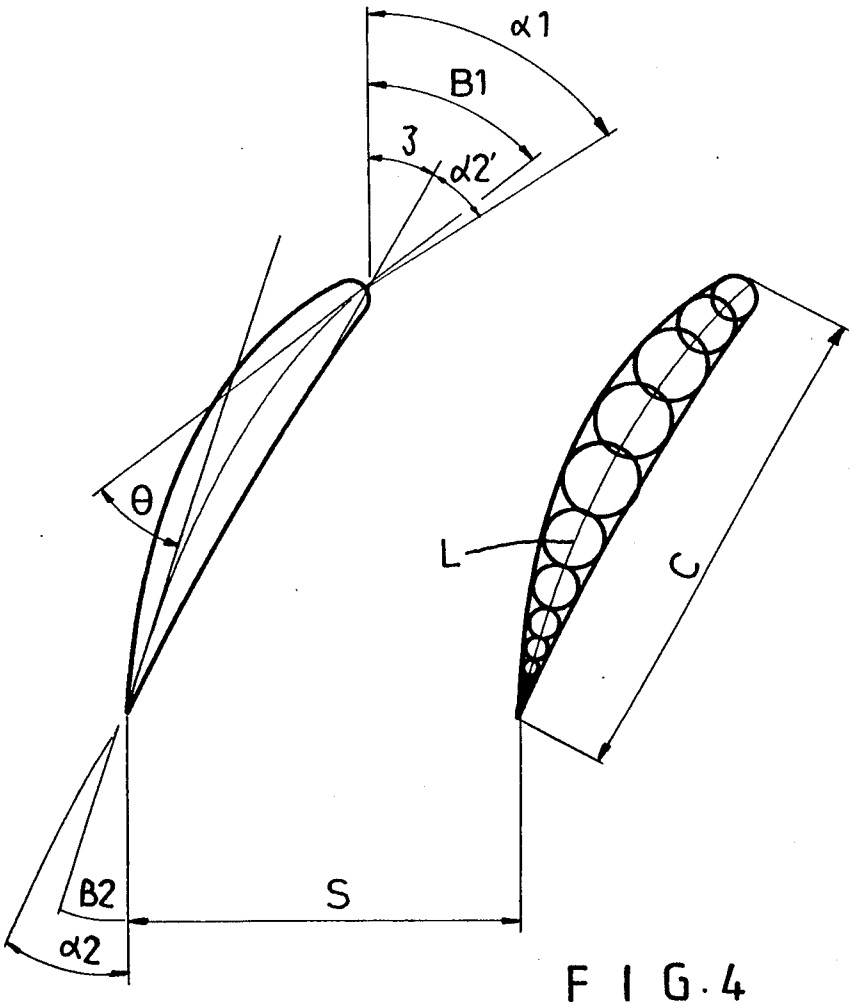
FIG. 4 illustrates the cross-sectional view of the blade of the fan shown in FIG. 1.

Referring to FIG. 4, it illustrates the cross-sectional view of the blade. The definition of the symbols illustrated in FIG. 4, are as follows:

a1, a2 represent the inlet angle and outlet angle of the air flow generated by the blade respectively;

$\beta 1$, $\beta 2$ represent the inlet angle and outlet angle of the cross-sectional surface of the blade respectively;

$\theta$represents the camber angle of the cross-sectional view of the blade;

i represents the attach angle of the cross-sectional view of the blade;

$\xi$represents the blade angle of the fan;

S represents the pitch length of the blade;

C represents the chord length of the blade; and

L represents the center line in the cross-sectional view of the blade.

C/S represents the chord/pitch ratio.

H represents the projected height of the blade in the axial direction.

Figure 6:
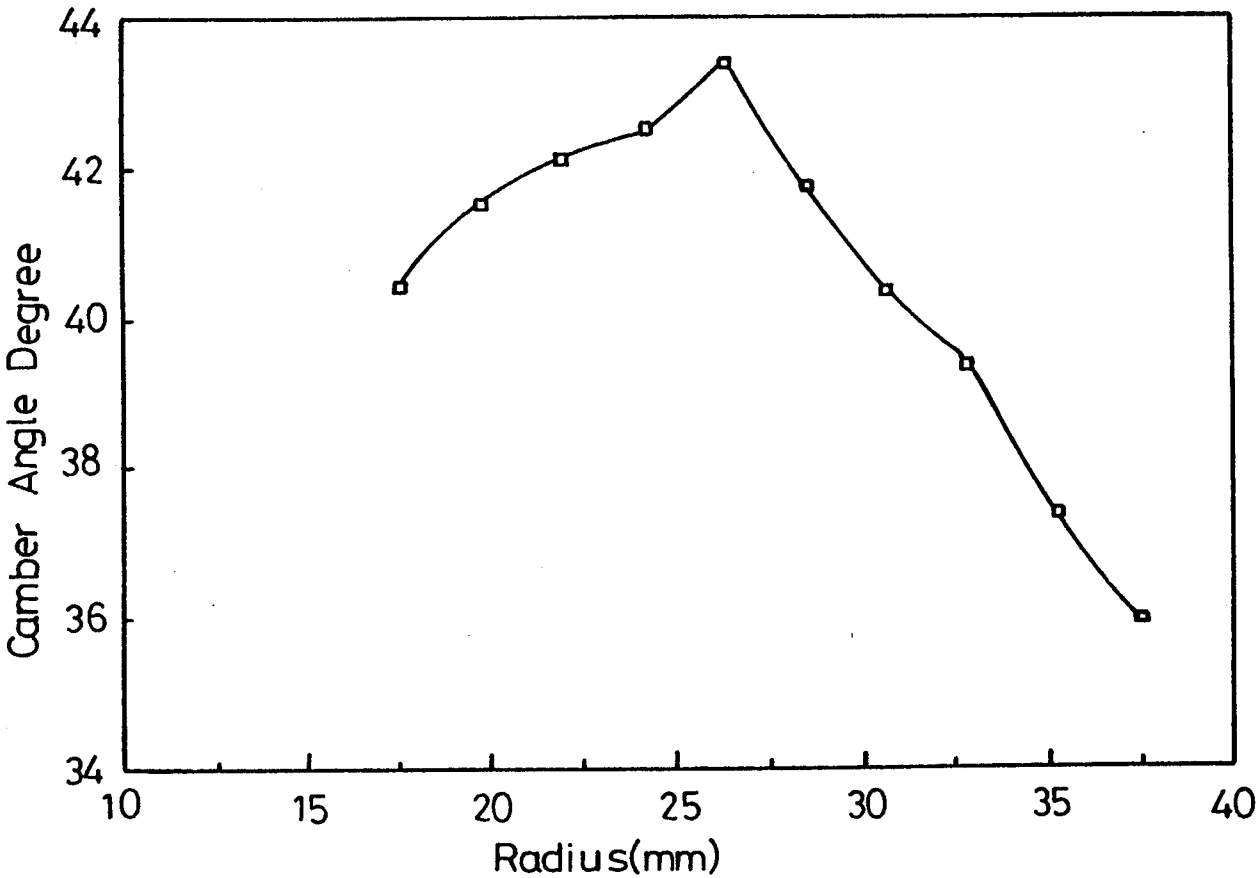
FIG. 6 is a graph depicting camber angle versus radius of the blade of the present invention.

In the preferred embodiment of the present invention the camber angle, referring to Table 1 again, ranges from 35.95 to 43.34 degrees. The relationship between the camber angle degree and the radius of the blade is graphically depicted in FIG. 6.

FIG. 7 is a graph depicting the relationship between the chord/pitch ratio and the radius of the blade of the present invention, in which the chord/pitch ratio is labeled as s/c. Taking from 10 symmetrical cross-sectional parts of the blade cut from its root portion to its tip portion, the chord/pitch ratios are 0.9, 0.85, 0.77, 0.7, 0.63, 0.56, 0.51, 0.47, 0.44, and 0.42 respectively In the preferred embodiment of the present invention, the leading edge skew angle of each blade is 47 degrees.

As to the effects of the present invention, the measured data are listed in Table 2 below:

TABLE 2

| Air Flow (CMM) | Fan Total Pressure | Static Pressure | Total Pressure Efficiency (%) | Static Pressure Efficiency (%) | Power (Watt) |
|---|---|---|---|---|---|
| 0.0661 | 3.5686 | 3.5625 | 1.9733 | 1.9700 | 1.9530 |
| 0.1712 | 2.5724 | 2.5313 | 4.4326 | 4.3618 | 1.6225 |
| 0.2905 | 1.8996 | 1.7813 | 6.3005 | 5.9079 | 1.4306 |
| 0.4047 | 1.4485 | 1.2188 | 7.0855 | 5.9618 | 1.3513 |
| 0.5166 | 1.4005 | 1.0312 | 8.2802 | 6.0752 | 1.4323 |
| 0.6290 | 1.1173 | 0.5625 | 8.3029 | 4.1801 | 1.3824 |
| 0.7192 | 0.7253 | 0.0000 | 6.6860 | 0.0000 | 1.2743 |

where the total efficiency and the static efficiency contain the rotation efficiency of the motor. The above measured noise level 28.7 db(A) of the present invention is lower than that 31 db(A) of the conventional axial fan.

In conclusion, the present invention provides a ultra-thin low-noise axial flow fan having features of obvious noise reduction and a miniatured outer casing with super thin dimension. Obviously, the operation features of the present invention are superior to that of the conventional axial fan, and the fan of the present invention is especially suitable for use in office automation machines.

So far, the feature of the present invention has been described. It will be obvious to those skilled in the art to use this invention according to the above detailed description. While the arrangement herein described constitutes a preferred embodiment of this invention, it is to be understood that various changes and modifications may be made therein without departing from the scope and spirit of the invention as defined in the appended claim.

I claim:

1. In a small axial flow fan having a driving motor, a central hub section driven by the driving motor, and a plurality of blades, each of the blades having a root portion, which is closest to the central hub portion, and a tip portion, which is furthest from the central hub portion, and each blade having two sides, wherein the improvement comprising:

(a) each blade being constructed in such a manner that the center line along each blade from the root portion to the tip portion of the blade having the shape of a circular arc, which is perpendicular to a circle defining the hub section at the root portion of the blade, said center line being defined as an arc connecting all middle points between corresponding end points at the two sides of the blades (b) each blade having a blade angle which is, measured from the root portion to the tip portion of the blade, at first directly proportional to the radius of the blade and then inversely proportional to the radius of the blade; and (c) each blade having a chord/pitch ratio which is inversely proportional to a radius of the blade from the root portion to the tip portion of the blade, thereby allowing said fan to provide high air flow, high pressure, low noise, and can be placed inside an ultra-thin outer casing.

2. An axial fan as claimed in claim 1, wherein each of the blades has a skew angle of forty-seven degrees, the skew angle is defined as the angle between a first line, which is tangential to the center line of the blade at the root portion thereof, and a second line, which is drawn connecting the root portion and the tip portion of the center line.

3. An axial fan as claimed in claim 1, wherein the blade angle of each blade ranges from 57–63 degrees.

4. An axial fan as claimed in claim 3 wherein each of the blades has blade angles of 57.9, 61.9, 63.9, 64.5, 63.9, 63.4, 62.6, 61.9, 61.5, and 63 degrees measured at 10 equal-width segments from the root portion to the tip portion of the blade.

5. An axial fan as claimed in claim 1 wherein each of the blades has chord/pitch ratio of 0.9, 0.85, 0.77, 0.63, 0.56, 0.51, 0.47, 0.44, 0.42 measured at 10 equal-width segments from the root portion to the tip portion of the blade.

6. An axial fan as claimed in claim 1, wherein the fan contains 7 blades secured to the central hub of the fan.

* * * * *